US011692287B2

(12) United States Patent
Shan et al.

(10) Patent No.: US 11,692,287 B2
(45) Date of Patent: Jul. 4, 2023

(54) METHOD FOR WEAVING THREE-DIMENSIONAL PREFORM HAVING GRADIENT STRUCTURE

(71) Applicant: BEIJING NATIONAL INNOVATION INSTITUTE OF LIGHTWEIGHT LTD., Beijing (CN)

(72) Inventors: Zhongde Shan, Beijing (CN); Feng Liu, Beijing (CN); Zheng Wang, Beijing (CN); Qun Zhang, Beijing (CN); Li Zhan, Beijing (CN); Juanjuan Qiao, Beijing (CN)

(73) Assignee: BEIJING NATIONAL INNOVATION INSTITUTE OF LIGHTWEIGHT LTD., Beijing (CN)

( * ) Notice: Subject to any disclaimer, the term of this patent is extended or adjusted under 35 U.S.C. 154(b) by 431 days.

(21) Appl. No.: 16/062,608

(22) PCT Filed: Dec. 2, 2016

(86) PCT No.: PCT/CN2016/108412
§ 371 (c)(1),
(2) Date: Jun. 14, 2018

(87) PCT Pub. No.: WO2017/101689
PCT Pub. Date: Jun. 22, 2017

(65) Prior Publication Data

US 2018/0363176 A1 Dec. 20, 2018

(30) Foreign Application Priority Data

Dec. 15, 2015 (CN) ..... 201510935317.9

(51) Int. Cl.
*D03D 41/00* (2006.01)
*D03D 25/00* (2006.01)
*D03D 1/00* (2006.01)

(52) U.S. Cl.
CPC ..... *D03D 25/005* (2013.01); *D03D 1/00* (2013.01); *D03D 41/004* (2013.01);
(Continued)

(58) Field of Classification Search
CPC ..... D03D 41/004; D03D 25/005; D04C 3/20; D04C 3/48
See application file for complete search history.

(56) References Cited

U.S. PATENT DOCUMENTS 4,615,256 A * 10/1986 Fukuta ..... D03D 41/004 139/11
4,936,186 A * 6/1990 Sekido ..... D04C 1/02 87/1

(Continued)

FOREIGN PATENT DOCUMENTS

CN 1068607 C 7/2001
CN 1851083 A 10/2006

(Continued)

OTHER PUBLICATIONS

Zhang, M., et al., "Study on Functionally Gradient Materials of Laminate Textile Structure", Journal of Textile Research, vol. 19, Issue 2, pp. 36-38 (Apr. 28, 1987).

(Continued)

*Primary Examiner* — Robert H Muromoto, Jr.
(74) *Attorney, Agent, or Firm* — Maschoff Brennan

(57) ABSTRACT

A method for weaving a three-dimensional preform includes the following steps: decomposing and determining performance requirements of different functional locations of the parts; selecting guide sleeves and fibers of each of the functional locations and designing a parameter; selecting guide sleeves and fibers of a transition area and designing a parameter, thereby implementing smooth transition of the transition area; determining a weaving sequence according (Continued)

to layouts of the guide sleeves and winding manners of the fibers in the functional locations and the transition area to generate a fiber iterative instruction for layer-by-layer weaving; arranging guide sleeves according to design requirements of the functional locations and the transition area to generate a guide sleeve array; and driving a weaving mechanism to select different fibers for subarea weaving layer by layer to obtain the three-dimensional preform having a gradient structure.

16 Claims, 2 Drawing Sheets

(52) U.S. Cl.
CPC ..... *D10B 2101/06* (2013.01); *D10B 2101/12* (2013.01); *D10B 2321/0211* (2013.01); *D10B 2331/021* (2013.01); *D10B 2401/04* (2013.01); *D10B 2401/06* (2013.01); *D10B 2401/16* (2013.01); *D10B 2401/18* (2013.01); *D10B 2505/02* (2013.01)

(56) References Cited

U.S. PATENT DOCUMENTS 5,767,023 A * 6/1998 Berger ..... B29C 70/24 139/384 R
5,891,962 A 4/1999 Otsuzuki et al.
6,105,622 A * 8/2000 Sternheim ..... D03D 41/004 139/11
7,077,167 B2 * 7/2006 Nayfeh ..... D03D 41/004 139/11
7,918,172 B2 * 4/2011 Weimer ..... B29B 11/16 112/475.08
8,600,541 B2 * 12/2013 Shan ..... D04H 3/04 700/131
9,103,054 B2 * 8/2015 Shan ..... D04C 3/02
10,016,912 B2 * 7/2018 Dunleavy ..... D03D 3/02
10,017,244 B2 * 7/2018 Mandel ..... B29C 66/72143
10,168,117 B2 * 1/2019 Curliss ..... F41A 21/04
10,195,761 B2 * 2/2019 Sherwood ..... B27D 1/10
10,315,367 B2 * 6/2019 Camus ..... B29C 70/543
10,325,038 B2 * 6/2019 Barreau ..... G06F 17/5018
10,345,094 B2 * 7/2019 Corradini ..... B29C 45/0005
2003/0186038 A1 * 10/2003 Ashton ..... B29C 37/0064 428/297.4
2008/0211195 A1 * 9/2008 Miyamoto ..... F01N 13/16 277/608
2012/0000810 A1 * 1/2012 Dry ..... B29C 73/22 206/524.1
2013/0073074 A1 * 3/2013 Shan ..... D04H 3/04 700/131
2015/0167209 A1 * 6/2015 Marchal ..... B29C 70/222 416/230

FOREIGN PATENT DOCUMENTS

CN 101232992 A 7/2008
CN 102358990 A 2/2012
CN 104395515 A 3/2015
CN 105442154 A 3/2016
EP 2 350 363 A1 8/2011
EP 2 791 473 A2 10/2014

OTHER PUBLICATIONS

Qiao, J., "Research on Interfacial Bonding Strength Between Guide-Sleeve and Resin in 3D Weaving", Master's Dissertation of China Academy of Machinery Science & Technology, pp. 6-7 (Oct. 31, 2012).

* cited by examiner

METHOD FOR WEAVING THREE-DIMENSIONAL PREFORM HAVING GRADIENT STRUCTURE

TECHNICAL FIELD

The present disclosure belongs to a field of a three-dimensional preform weaving and particularly relates to a method for weaving a three-dimensional preform having a gradient structure.

BACKGROUND

Yarns in a three-dimensional preform have three or more directions and an internal yarn mostly is in a stretched state. As a reinforcement material, the three-dimensional preform is used for manufacturing an advanced composite material. It has been successfully used in high-tech fields such as aviation, aerospace, ships and rail traffics, and has good development prospect.

Currently, the three-dimensional preform is mainly implemented by a machine knitting process, a three-dimensional braiding process and a fine weave piercing process. According to a method for weaving a triaxial orthorhombic structure fabric using a machine knitting process disclosed by a Chinese patent CN1068607A, a movement of a heald frame is controlled by a multi-arm mechanism to form a multi-layer movable shed, yarns are inserted alternately at two sides using two or more weft insertion needles, and the yarns on a Z direction are divided into upper and lower layers and are also controlled by the heald frame. The fabric weaved with the method may be 20 mm-100 mm wide, but there are only two directions (0° and 90°) for fibers on an X-Y plane. Such method is limited by a device and cannot weave a three-dimensional preform having a gradient structure. For the fine weave piercing process, a carbon fiber plain fabric or satin fabric is pierced layer by layer using a steel needle array, and after a required fabric thickness is reached, carbon fiber bundles are used to replacing steel needles one by one to form a three-direction orthorhombic structure. The fine weave piercing process may implement the weaving of a large-thickness fabric. However, since the carbon fiber plain fabric or satin fabric is used for piercing, the method cannot weave the three-dimensional preform having the gradient structure on the plane.

SUMMARY

Some embodiments of the present disclosure provide a method for weaving a three-dimensional preform having a gradient structure. The method is applied to a preform of a part on which different portions have different loading conditions and different functions.

A method for weaving a three-dimensional preform having a gradient structure provided by the present disclosure specifically includes the following steps:

(a) according to service environment, operating mode and loading condition of a required composite material parts, performance requirements of different functional locations of the parts are decomposed and determined, transition areas are divided;

(b) according to performance requirements of the different functional locations of the parts, different varieties and specifications of guide sleeves and fibers are selected, and different arrangement manners and arrangement spaces of the guide sleeves, winding manners of fibers and densities of winding layers of the fibers are designed;

(c) varieties, specifications, arrangement manners and arrangement spaces of guide sleeves in the transition areas are designed, and varieties, specifications and winding manners of fibers as well as densities of winding layers in the transition areas are designed, thereby implementing the transition areas smooth;

(d) a weaving sequence is determined in a computer according to layouts of the guide sleeves, the winding manners of the fibers on the functional locations and in the transition areas, then generate a fiber iterative instruction for layer-by-layer weaving;

(e) guide sleeves are arranged according to design requirements of the functional locations and the transition areas and then generate a guide sleeve array;

(f) a weaving mechanism is driven to select different fibers for subarea weaving layer by layer in the guide sleeve array till the weaving of all fiber layers is finished to obtain the three-dimensional preform having a gradient structure.

In an exemplary embodiment, the different functional locations in the step (a) are portions with different structural performances such as bearing a static load and dynamic load, an instability resistance and an impact resistance, or different functional performances such as an electromagnetic performance, a conductivity, a heat resistance, a fire resistance, a corrosion resistance and an absorbing property.

In an exemplary embodiment, varieties of the guide sleeves in the step (b) comprise a carbon fiber composite material, a glass fiber composite material, a titanium alloy and a stainless steel; varieties of the fibers comprise a carbon fiber, a glass fiber, an aramid fiber, an ultra-high molecular weight polyethylene fiber and a quartz fiber.

In an exemplary embodiment, arrangement manners of the guide sleeves in the steps (b) and (c) comprise a regular quadrangle, a rectangle, a triangle, a hexagon and an annular shape.

In an exemplary embodiment, a smooth transition manner of the transition area in the step (c) includes: when the functional locations are made of different fiber materials, the transition area is in gradual transition using multiple fibers according to a proportion.

In an exemplary embodiment, a smooth transition manner of the transition area in the step (c) includes: when volume fractions of the fibers on the functional locations are different, densities of fiber winding layers in the transition area are in a gradual transition.

In an exemplary embodiment, a smooth transition manner of the transition area in the step (c) includes: when arrangement spaces of the guiding sleeves on the functional locations are different, the arrangement spaces of the guiding sleeves in the transition area are in an equidifferent transition.

In an exemplary embodiment, a smooth transition manner of the transition area in the step (c) includes: when guiding sleeves on different functional locations are made of different materials, the guide sleeves in the transition area are in transition with considerations to a gradient layout of the materials of guide sleeves on the functional locations.

In an exemplary embodiment, the arrangement spaces of the guide sleeves in the step (b) are 1.0 mm-5.0 mm.

In an exemplary embodiment, the winding manners of the fibers in the step (b) are of a straight line shape or an '8' shape.

In an exemplary embodiment, structures and sizes of fabric units of the transition area in the step (c) are continuously changed, and material compositions are also continuously changed and are uniformly transited from one attribute to another attribute.

Compared with the prior art, the present disclosure has the following advantages.

(1) Through a computer assistance to generate a fiber iterative instruction, the weaving and forming of the preform are implemented; during a weaving process, the reliance on the manpower is small and the reliability is good.

(2) The method can realize the weaving of the composite material three-dimensional preform having a gradient structure and is particularly applied to a composite material parts and the like on which different portions have different loading conditions.

(3) The method of the disclosure is also applied to preparing a composite material preform having multiple matrix types and reinforced by multiple materials.

BRIEF DESCRIPTION OF THE DRAWINGS

The accompanying drawings are described here to provide a further understanding of the present disclosure. The schematic embodiments and description of the present disclosure are adopted to explain the present disclosure and do not form improper limits to the present disclosure. In the drawings.

The accompanying drawings include the following reference numbers:

1. full fiber weaving area; 2. transition area; 3. weaving area using carbon fiber composite material guide sleeves on a Z direction; 4. carbon fiber bundle guide sleeve; 5. carbon fiber; 6. carbon fiber composite material guide sleeve.

DETAILED DESCRIPTION OF THE EMBODIMENTS

Figure 1:
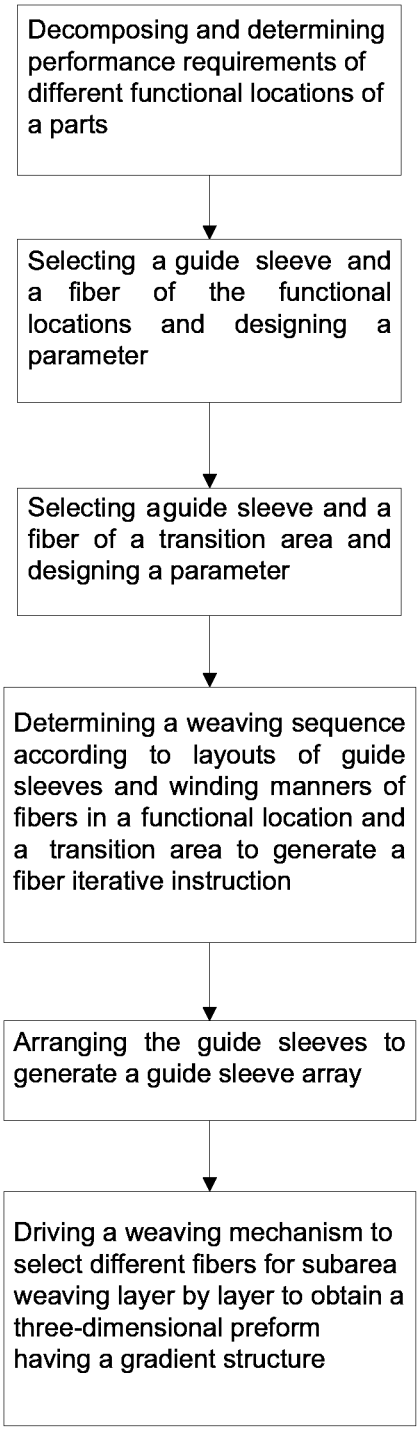
FIG. 1 is a flowchart of a designing and manufacturing method of a function gradient composite material of a present disclosure.

As shown in FIG. 1, according to an exemplary embodiment of the present disclosure, a method for weaving a three-dimensional preform having a gradient structure is provided, the method includes the following steps.

(a), according to a service environment and an operating mode and loading condition of required composite material parts, performance requirements of different functional locations of the parts are decomposed and determined and transition areas are divided, thereby implementing primary division of gradient areas of the parts.

(b), according to performance requirements of the different functional locations of the parts, different varieties and specifications of guide sleeves and fibers are selected, and different arrangement manners and arrangement spaces of guide sleeves, winding manners of fibers and densities of winding layers of the fibers are designed, thereby obtaining guide sleeve arrangement and fiber winding implementation manners of each function gradient area.

(c), varieties, specifications, arrangement manners and arrangement spaces of guide sleeves in the transition areas are designed, and varieties, specifications and winding manners of fibers as well as densities of the winding layers in the transition area are designed, thereby implementing a smooth transition of the transition area so as to implement smooth transition of a material gradient and a structure gradient between the transition area and the functional locations.

(d), a weaving sequence is determined in a computer according to layouts of the guide sleeves and the winding manners of the fibers in the functional locations and the transition area to generate a fiber iterative instruction for layer-by-layer weaving. Through computer assistance to generate the fiber iterative instruction, a precision controllable weaving and forming of the preform can be implemented. During a weaving process, the reliance on the manpower is small and the reliability is good.

(e), guide sleeves are arranged according to design requirements of the functional locations and the transition area to generate a guide sleeve array having a changeable gradient of the functional locations and the transition area.

(f), a weaving mechanism is driven to select different fibers for subarea weaving layer by layer in the guide sleeve array till the weaving of all fiber layers is finished to obtain the three-dimensional preform having a gradient structure. The fibers on the functional locations and transition portions are continuous layer by layer, so the integrity of the preform is good.

According to a method for weaving the three-dimensional preform provided by the disclosure, by adopting the computer assistance to generate the fiber iterative instruction, the precision controllable weaving and forming of the preform can be implemented; during the weaving process, the reliance on the manpower is small and the reliability is good; meanwhile, the method for weaving the three-dimensional preform provided by the disclosure can realize the weaving of the composite material preform having the gradient structure, and is particularly applied to researching a composite material parts and the like on which different portions have different loading conditions; and furthermore, for the three-dimensional preform obtained by applying the method of the present disclosure, the fibers on the functional locations and the transition portions are continuous layer by layer, so the integrity of the preform is good.

In an exemplary embodiment, the different functional locations in the step (a) are portions with different structural performances such as bearing a static load and a dynamic load, an instability resistance and an impact resistance, or having different functional performances such as an electromagnetic performance, a conductivity, a heat resistance, a fire resistance, a corrosion resistance and an absorbing property.

In an exemplary embodiment, varieties of the guide sleeves in the step (b) comprise a carbon fiber composite material, a glass fiber composite material, a titanium alloy and a stainless steel; the varieties of the fibers include a carbon fiber, a glass fiber, an aramid fiber, an ultra-high molecular weight polyethylene fiber and a quartz fiber; arrangement manners of the guide sleeves in the steps (b) and (c) comprise a regular quadrangle, a rectangle, a triangle, a hexagon and an annular shape.

In an exemplary embodiment, a smooth transition manner of the transition area in the step (c) includes: when the functional locations are made of different fiber materials, the transition area is in constant speed transition using multiple fibers according to a proportional change of different fibers; when volume fractions of the fibers on the functional locations are different, the densities of fiber winding layers in the transition area are in a gradual transition; when arrangement spaces of the guiding sleeves on the functional locations are different, arrangement spaces of the guiding sleeves in the transition area are in equidifferent transition; when the guiding sleeves on different functional locations are made of different materials, the guide sleeves in the transition area are in transition with considerations to a gradient layout of the materials of the guide sleeves on the functional parts.

In an exemplary embodiment, in the present disclosure, the arrangement spaces of the guide sleeves in the step (b) are 1.0 mm-5.0 mm. The winding manners of the fibers in the step (b) are of a straight line shape or an '8' shape.

In the present disclosure, the structures and the sizes of fabric units of the transition area in the step (c) are continuously changed, and the material compositions are also continuously changed and are uniformly transited from one attribute to another attribute.

Figure 2:
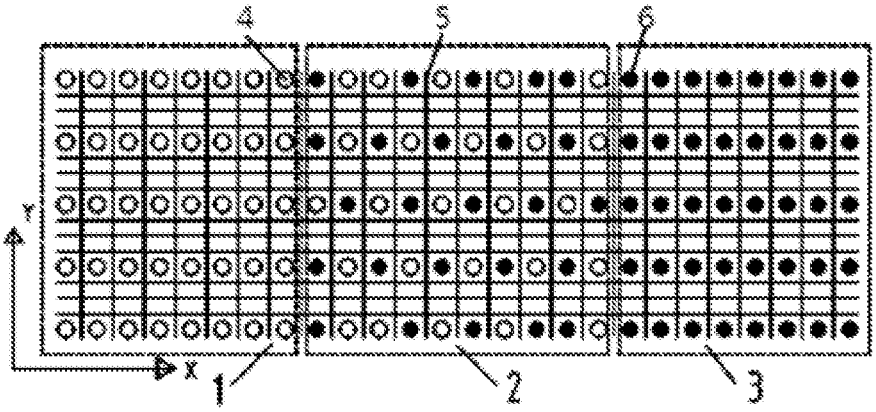
FIG. 2 is a structural systematic diagram of an embodiment of the present disclosure.

In order to have a further understanding on the present disclosure, one specific embodiment of the present disclosure will be described below with reference to FIG. 2.

Firstly, a fiber reinforced composite material preform for which a dimension of a carbon fiber cross section is 250 mm×80 mm×30 mm is made and the work condition is that a main body structure bears a static load and an X-direction left side bears parts of a dynamic load. A structure of the preform is divided into three portions. As shown in FIG. 2, the three portions respectively are a full-fiber weaving area 1, a weaving area 3 of using carbon fiber composite material guide sleeves on a Z direction, and a transition area 2 between the full-fiber weaving area 1 and the weaving area 3 of using the carbon fiber composite material guide sleeves on the Z direction.

Secondly, according to an overall loading condition, fibers are paved on X, Y and Z directions in a space, and an X direction and a Y direction fibers, penetrating the full-fiber weaving area 1 and the weaving area 3 of using the carbon fiber composite material guide sleeves on the Z direction, are applying T300-6K carbon fibers 5; the fiber winding manner is a straight line type and a layer density is 20 layers per cm; stranded T300-6K fiber bundles are used in the full-fiber weaving area 1 to take as Z-direction carbon fiber bundle guide sleeves 4; 2.0 mm-diameter carbon fiber composite material guide sleeves 6 are used by a Z direction of the weaving area 3 of using the carbon fiber composite material guide sleeves on the Z direction; the guide sleeves are provided in a layout of a regular quadrangle and the arrangement spaces all are 5.0 mm.

Thirdly, the transition area 2 gives considerations to the Z-direction carbon fiber bundle guide sleeves 4 and the carbon fiber composite material guide sleeves 6 and two sides of the transition area 2 are in gradient changeable symmetric transition, such that the change uniformity, the fiber continuity and the structural integrity of the material are effectively guaranteed.

Fourthly, according to arrangement manners of the guide sleeves in the full-fiber weaving area 1, the weaving area 3 of using the carbon fiber composite material guide sleeves on the Z direction and the transition area 2 of the functional locations, the guide sleeves in the full-fiber weaving area 1, the transition area 2 and the weaving area 3 of using the carbon fiber composite material guide sleeves on the Z direction are arranged, then generate a 36 (rows)*12 (columns) perform guide sleeve array.

Fifthly, fiber winding manners, densities of the winding layers and weaving sequences of the functional locations and the transition area are matched in a computer to generate an integral fiber iterative instruction for total 60 layers on the Z direction.

Sixthly, a weaving mechanism is driven to carry the fiber to weave in the guide sleeve array layer by layer till the weaving of all fiber layers is finished to obtain a three-dimensional perform having a gradient change of fiber arrangements.

The above is only an exemplary embodiment of the present disclosure and is not used to limit the present disclosure. To a person skilled in the art, the present disclosure may have various changes and variations. And any modification, equivalent replacement, replacement and the like made within the spirits and principles of the present disclosure all shall be included in a scope of protection of the present disclosure.

What is claimed is:

1. A method for weaving a three-dimensional preform having a gradient structure, comprising the following steps:

(a) according to service environment, operating mode and loading condition of a required composite material parts, dividing and determining performance requirements of different functional locations of the parts, and determining a transition area;

(b) according to the performance requirements of the different functional locations of the parts, selecting different varieties and specifications of guide sleeves and fibers, and designing different arrangement manners and arrangement spaces of the guide sleeves, winding manners of fibers and densities of winding layers of the fibers;

(c) designing varieties, specifications, arrangement manners and arrangement spaces of guide sleeves in the transition area, and designing varieties, specifications and winding manners of fibers as well as densities of winding layers in the transition area, thereby implementing smooth transition of the transition area; wherein a smooth transition manner of the transition area in the step (c) comprises: wherein the functional locations are made of different fiber materials, the transition area is in gradual transition using multiple fibers according to a proportional change of different fibers; wherein volume fractions of the fibers on the functional locations are different, densities of fiber winding layers in the transition area are in a gradual transition; wherein arrangement spaces of the guiding sleeves on the functional locations are different, the arrangement spaces of the guiding sleeves in the transition area are in an equidifferent transition; wherein guiding sleeves on different functional locations are made of different materials, the guide sleeves in the transition area are in transition with considerations to a gradient layout of the materials of guide sleeves on the functional locations;

(d) determining a weaving sequence in a computer according to layouts of the guide sleeves, the winding manners of the fibers on the functional locations and in the transition areas, then generate a fiber iterative instruction for layer-by-layer weaving;

(e) arranging guide sleeves according to design requirements of the functional locations and the transition areas and then generate a guide sleeve array; and (f) driving a weaving mechanism to select different fibers for subarea weaving layer by layer in the guide sleeve array till the weaving of all fiber layers is finished to obtain the three-dimensional preform having a gradient structure.

2. The method for weaving the three-dimensional preform having the gradient structure as claimed in claim 1, wherein the different functional locations in the step (a) are portions with different structural performances such as bearing a static load and a dynamic load, an instability resistance and an impact resistance, or different functional performances such as an electromagnetic performance, a conductivity, a heat resistance, a fire resistance, a corrosion resistance and an absorbing property.

3. The method for weaving the three-dimensional preform having the gradient structure as claimed in claim 1, wherein:

varieties of the guide sleeves in the step (b) comprise a carbon fiber composite material, a glass fiber composite material, a titanium alloy and a stainless steel; and varieties of the fibers comprise a carbon fiber, a glass fiber, an aramid fiber, an ultra-high molecular weight polyethylene fiber and a quartz fiber.

4. The method for weaving the three-dimensional preform having the gradient structure as claimed in claim 1, wherein arrangement manners of the guide sleeves in the steps (b) and (c) comprise a regular quadrangle, a rectangle, a triangle, a hexagon and an annular shape.

5. The method for weaving the three-dimensional preform having the gradient structure as claimed in claim 1, wherein the arrangement spaces of the guide sleeves in the step (b) are 1.0 mm-5.0 mm.

6. The method for weaving the three-dimensional preform having the gradient structure as claimed in claim 1, wherein the winding manners of the fibers in the step (b) are of a straight line shape or an '8' shape.

7. The method for weaving the three-dimensional preform having the gradient structure as claimed in claim 1, wherein structures and sizes of fabric units of the transition area in the step (c) are continuously changed, and material compositions are also continuously changed and are uniformly transited from one attribute to another attribute.

8. A method for weaving a three-dimensional preform having a gradient structure, comprising the following steps:

(a) decomposing and determining performance requirements of different functional locations of a parts, and dividing a transition area;

(b) designing a guide sleeve layout and a fiber winding manner of each of the functional locations;

(c) designing a guide sleeve layout and a fiber winding manner of the transition area, wherein a smooth transition manner of the transition area in the step (c) comprises: wherein the functional locations are made of different fiber materials, the transition area is in gradual transition using multiple fibers according to a proportional change of different fibers; wherein volume fractions of the fibers on the functional locations are different, densities of fiber winding layers in the transition area are in a gradual transition; wherein arrangement spaces of the guiding sleeves on the functional locations are different, the arrangement spaces of the guiding sleeves in the transition area are in an equidifferent transition; wherein guiding sleeves on different functional locations are made of different materials, the guide sleeves in the transition area are in transition with considerations to a gradient layout of the materials of guide sleeves on the functional locations;

(d) determining a weaving sequence according to layouts of guide sleeves and winding manners of fibers on the functional locations as well as layouts of guide sleeves and winding manners of fibers in the transition area; and (e) finishing a weaving of all fiber layers according to the weaving sequence.

9. The method for weaving the three-dimensional preform having the gradient structure as claimed in claim 8, further comprising after determining the weaving sequence:

arranging guide sleeves according to the design requirements of the functional locations and the transition area to generate a guide sleeve array; and finishing the weaving of the all fiber layers according to the weaving sequence.

10. The method for weaving the three-dimensional preform having the gradient structure as claimed in claim 8, wherein in the step (a), according to a service environment and an operating mode and loading condition of the parts, performance requirements of the different functional locations of the parts are decomposed and determined and the transition area is divided.

11. The method for weaving the three-dimensional preform having the gradient structure as claimed in claim 8, wherein in the step (b), according to performance requirements of the different functional locations of the parts, different varieties and specifications of guide sleeves and fibers are selected, and different layouts of guide sleeves, winding manners of fibers and densities of winding layers are designed.

12. The method for weaving the three-dimensional preform having the gradient structure as claimed in claim 8, wherein in the step (c), varieties, specifications and layouts of guide sleeves in the transition area are designed, and varieties, specifications and winding manners of fibers as well as densities of winding layers in the transition area are designed, thereby implementing smooth transition of the transition area.

13. The method for weaving the three-dimensional preform having the gradient structure as claimed in claim 9, wherein in the step (d), the weaving sequence is determined in a computer according to layouts of guide sleeves and winding manners of fibers on the functional locations as well as layouts of guide sleeves and winding manners of fibers in the transition area so as to generate a fiber iterative instruction for layer-by-layer weaving.

14. The method for weaving the three-dimensional preform having the gradient structure as claimed in claim 8, wherein in the step (e), a weaving mechanism is driven to select different fibers for subarea weaving layer by layer in the guide sleeve array till the weaving of the all fiber layers is finished.

15. The method for weaving the three-dimensional preform having the gradient structure as claimed in claim 11, wherein each of the layouts of the guide sleeves comprises an arrangement manner and an arrangement space of the guide sleeves.

16. The method for weaving the three-dimensional prefabricated body having the gradient structure as claimed in claim 12, wherein each of the layouts of the guide sleeves comprises an arrangement manner and an arrangement space of the guide sleeves.

* * * * *